US007667152B2

(12) United States Patent
Su

(10) Patent No.: US 7,667,152 B2
(45) Date of Patent: Feb. 23, 2010

(54) LUMINOUS MICRO-SWITCH

(75) Inventor: Tsui-Jung Su, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 14 days.

(21) Appl. No.: 12/038,897

(22) Filed: Feb. 28, 2008

(65) Prior Publication Data

US 2009/0218204 A1 Sep. 3, 2009

(51) Int. Cl.
*H01H 9/00* (2006.01)

(52) U.S. Cl. ..... 200/314; 200/313

(58) Field of Classification Search ..... 200/313, 200/314

See application file for complete search history.

(56) References Cited

U.S. PATENT DOCUMENTS 7,145,087 B1 12/2006 Su
7,202,429 B2 * 4/2007 Bouvier et al. ..... 200/310
7,253,368 B1 8/2007 Chou
2005/0263380 A1 * 12/2005 Bouvier et al. ..... 200/310

FOREIGN PATENT DOCUMENTS

TW M311997 5/2007

* cited by examiner

*Primary Examiner*—Kyung Lee
(74) *Attorney, Agent, or Firm*—Muncy, Geissler, Olds & Lowe, PLLC

(57) ABSTRACT

A luminous micro-switch mainly includes a case which holds a depressing member and at least a first pin and a second pin inside that are spaced from each other. There is a bridging member interposed between the two pins and the depressing member to form electric connection with the first pin in regular conditions and output a signal when the bridging member is connected to the second pin due to depressing of the depressing member. The depressing member has a depressing end which has a holding trough to hold a lighting element which has two conductive terminals to receive electric power to generate light. By holding the lighting element in the holding trough the size of the micro-switch can be made smaller to be used on smaller electronic devices to overcome the bulky problem of conventional micro-switches caused by disposing the lighting element beneath the depressing member.

7 Claims, 9 Drawing Sheets

LUMINOUS MICRO-SWITCH

FIELD OF THE INVENTION

The present invention relates to a luminous micro-switch and particularly to a small micro-switch that has a lighting element located thereon.

BACKGROUND OF THE INVENTION

Micro-switch now is widely used in almost all types of information appliances (IAs), such as mobile phones, PDAs, computer keyboards and the like. U.S. Pat. No. 7,253,368 discloses a button switch which has an insulation seat with a wiring space formed therein to hold a first pin and a second pin that are spaced from each other. Through a depressing action the first pin is electrically connected to the second pin through a conductive connecting member to output a signal.

In order to facilitate recognition of switches or information on pushbuttons of the IAs, some micro-switches have a light source embedded inside to allow light to pass through the switches or pushbuttons. Such a design not only makes operation easier for users at night or in a poorly lit environment, also can enhance the added-value of the products. For instance, R.O.C. patent No. M311997 discloses a switch which mainly has an insulation body to hold a first conductive terminal, a second conductive terminal and a third conductive terminal. There are also an elastic reed, a depressing member, an anchor member, an LED and an operation member located therein in this order. These elements are held in the insulation body through a case. The operation member has one end exposed outside the case and is depressible for operation. The operation member receives a depressing force to drive the anchor member and the depressing member downwards to press the elastic reed so that the first and third terminals are electrically connected to output a signal. The LED is electrically connected to the second terminal to receive electric power and generate light which emits outside the switch through the operation member.

Although the patent set forth above can generate light in the switch, the LED is located in the operation member. Hence the operation member has to provide an adequate space inside to prevent interference with the LED while it is moved downwards. Although it provides required contact during operation, the switch is quite bulky due to the need to accommodate the LED and operation member. This is against the prevailing trend of slim and light in the design of IAs to improve portability. All the conventional designs previously discussed do not provide a desirable solution to address such a requirement. There is still room for improvement.

SUMMARY OF THE INVENTION

The primary object of the present invention is to solve the aforesaid disadvantages by providing a micro-switch that can be made at a smaller size to be used on shrinking electronic devices.

To achieve the foregoing object the invention provides a luminous micro-switch which mainly includes a case to hold a depressing member and at least a first pin and a second pin that are spaced from each other. The two pins and the depressing member are interposed by a bridging member to form electric connection with the second pin in regular conditions. The bridging member is depressible by the depressing member to connect the first pin to output a signal. The depressing member has a pressing end which has a holding trough to hold a lighting element. The lighting element has two legs to receive electric power to generate light. By holding the lighting element in the holding trough the size of the luminous micro-switch can be made smaller. Thus it can be used on a wide variety of smaller electronic devices.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
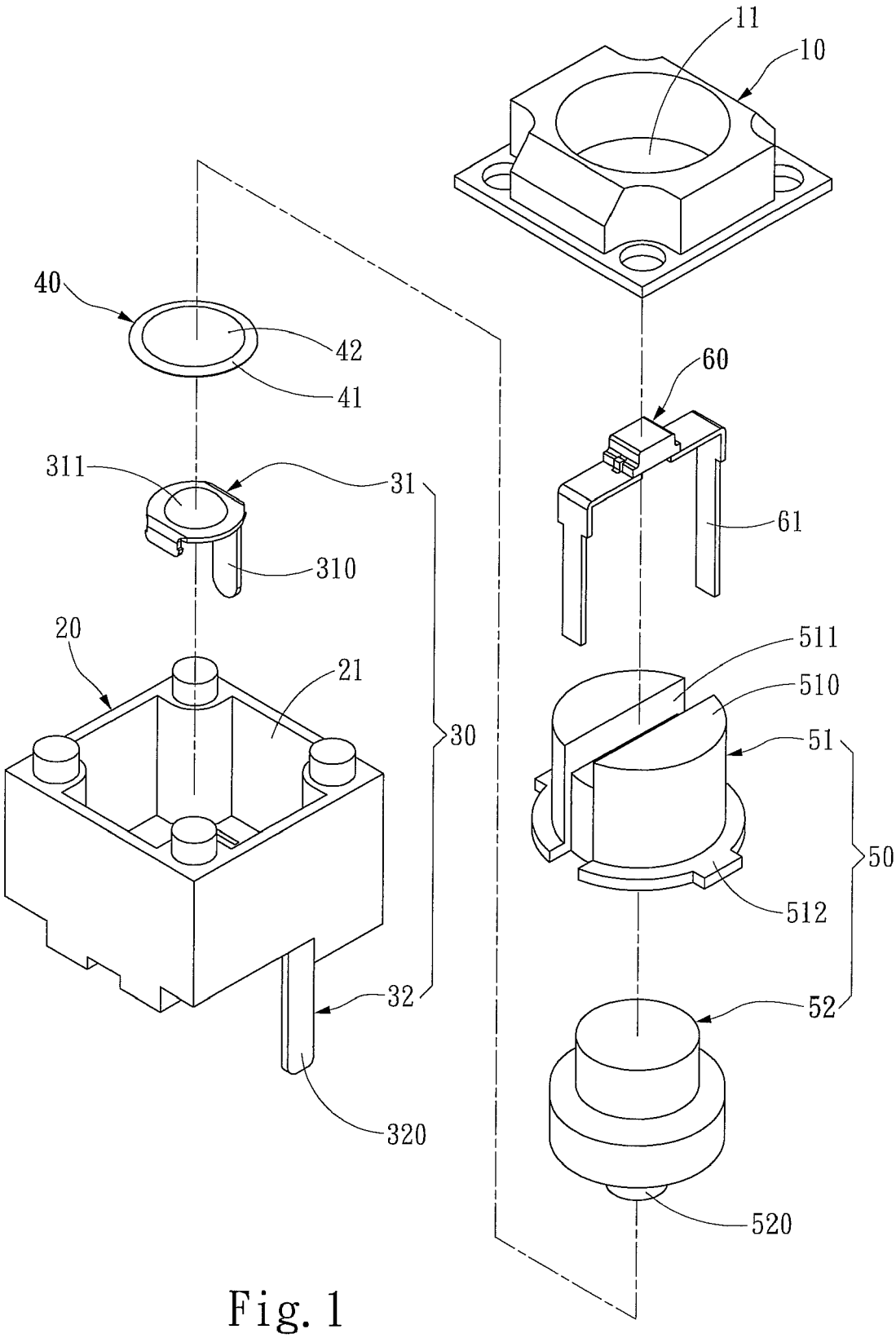
FIG. 1 is an exploded view of the invention.
Figure 2A:
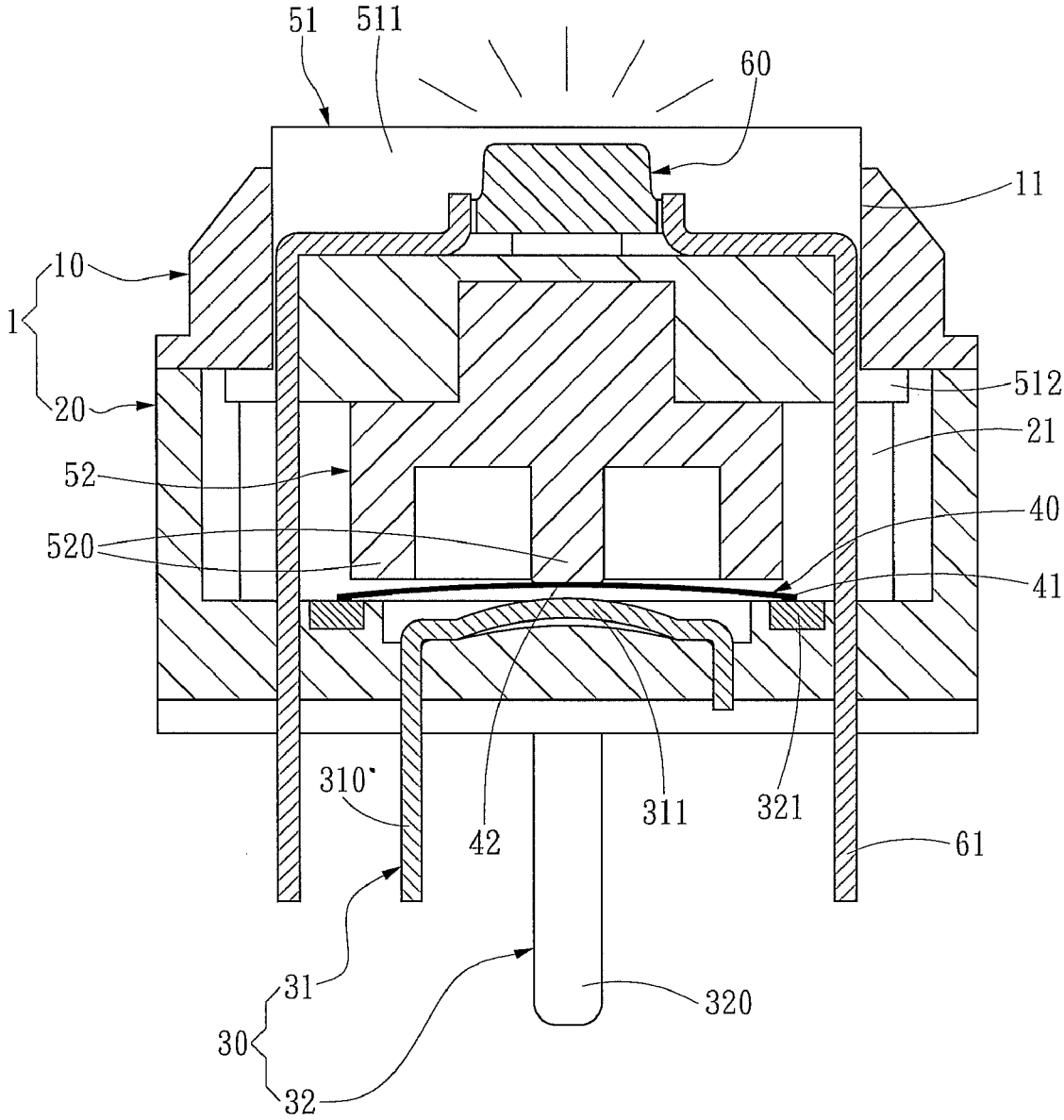
FIGS. 2A and 2B are schematic views of a first embodiment of the invention in operating conditions.

Please refer to FIGS. 1 and 2A, the luminous micro-switch according to the invention mainly includes a case 1 which consists of an upper cap 10 and a base 20 coupling together. The base 20 has a housing chamber 21 inside to hold a pin set 30. The pin set 30 has a first pin 31 and a second pin 32 embedded separately in the housing chamber 21 through an injection process. The first and second pins 31 and 32 have respectively an electric connecting section 310 and 320 extended outside the base 20 to receive an external signal and a depressing coupling section 311 and 321 located in the housing chamber 21 and on the surface of the base 20. The upper cap 10 has an opening 11 to hold a depressing member 50 in the housing chamber 21. There is a bridging member 40 interposed between the depressing member 50 and the two pins 31 and 32. The bridging member 40 is a circular dome type reed with a contact rim 41 formed at the perimeter to be electrically connected to the depressing coupling section 321 of the second pin 32 in regular conditions and an arched center zone to form a dome top portion 42 straddling the first pin 31. In addition, the depressing member 50 has a retaining portion 512 leaning to the dome top portion 42 by gravity when not subject to forces and being braced by the bridging member 40 to hold the upper cap 10 in a retaining position so that the depressing member 50 is confined in the housing chamber 21 without escaping the case 1. It is to be noted that the depressing member 50 has a depressing end 510 to receive forces from a user. The depressing end 510 has a holding trough 511 to hold a lighting element 60 such as an LED. The lighting element 60 has two conductive terminals 61 to receive electric power to generate light. With the lighting element 60 held in the holding trough 511 of the depressing end 510, the size of the switch is smaller compared with the conventional micro-switch that has the lighting element 60 installed beneath the depressing member 50 at a position without being hit by the downward moving depressing member 50. Thus the invention is adoptable to a wide variety of smaller electronic devices.

Figure 2B:
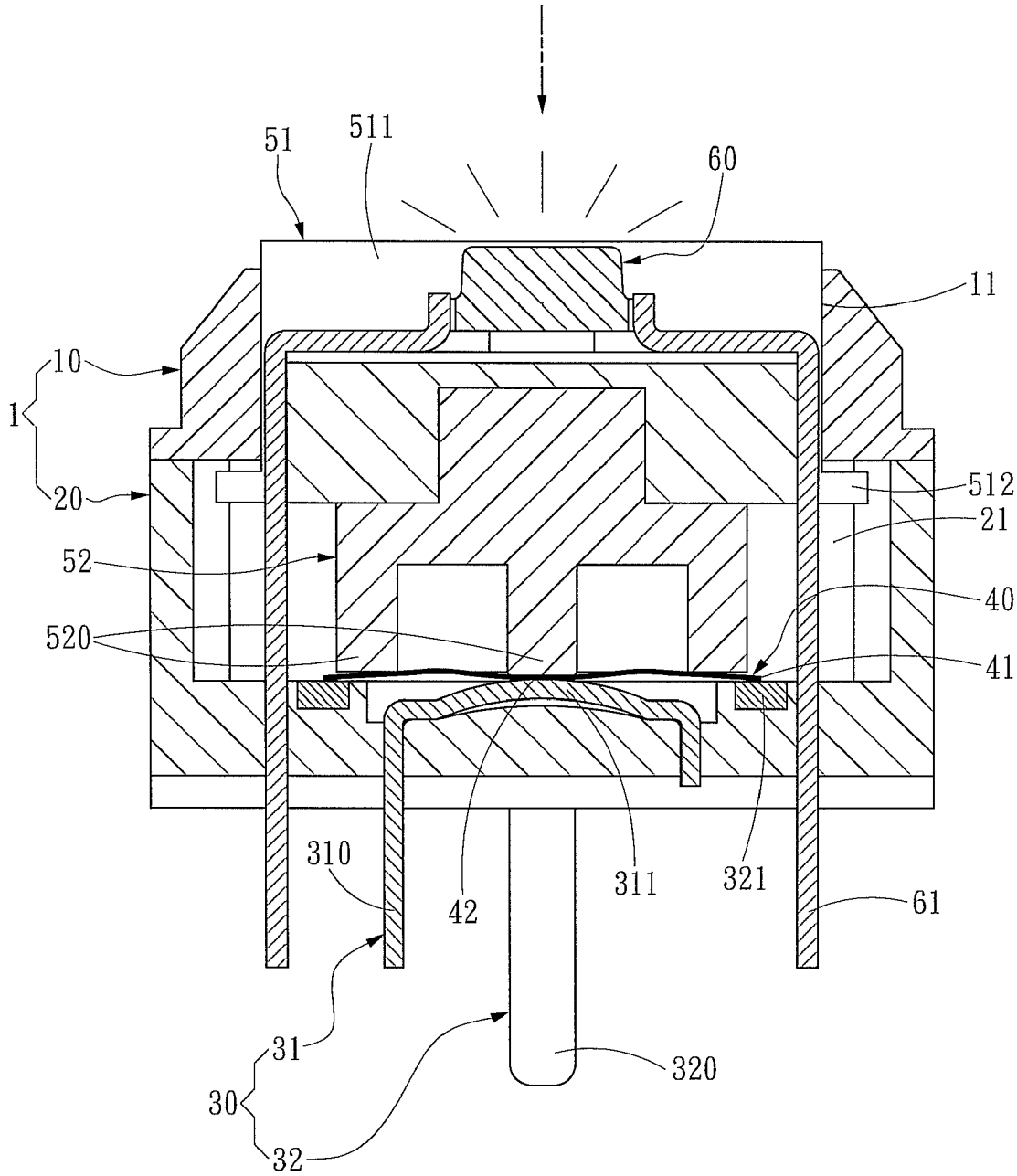

When in use the depressing member 50 of the invention is movable up and down under a depressing action. It has a depressible pushbutton 51 and a bucking button 52 located beneath the pushbutton 51. The bucking button 52 has a pressing end 520 to press the dome top portion 42 and the contact rim 41. When the pushbutton 51 receives a force the bucking button 52 is driven and the pressing end 520 compresses the bridging member 40. The lighting element 60 generates light in varying fashions according to configured conditions of the two terminals 61 as shown in FIGS. 2A and 2B. The two conductive terminals 61 are extended outside the base 20. Initially, the pushbutton 51 does not receive forces and is held by the bridging member 40 and the bucking button 52 to rest on a lower side of the upper cap 10 through the retaining portion 512. The lighting element 60 receives external electric power through the two conductive terminals 61 to generate light (referring to FIG. 2A). When a depressing action takes place, the pushbutton 51 receives a force to drive the bucking button 52 downwards, the pressing end 520 compresses the contact rim 41 of the bridging member 40 to press the depressing section 321 of the second pin 32, and the dome top portion 42 is deformed to connect the depressing section 311 of the first pin 31 so that the first pin 31 and the second pin 32 are electrically connected to output a signal. Meanwhile the lighting element 60 also is energized by the external electric power and generates light (referring to FIG. 2B). When the depressing action stops, the pushbutton 51 is pushed by the bridging member 40 and bucking button 52 to return to its original position, and the first pin 31 is separated from the second pin 32 to release the conductive condition, hence signal output is stopped, but the lighting element 60 maintains the lighting condition. Thus the micro-switch continuously generates light in the regular conditions.

Figure 3A:
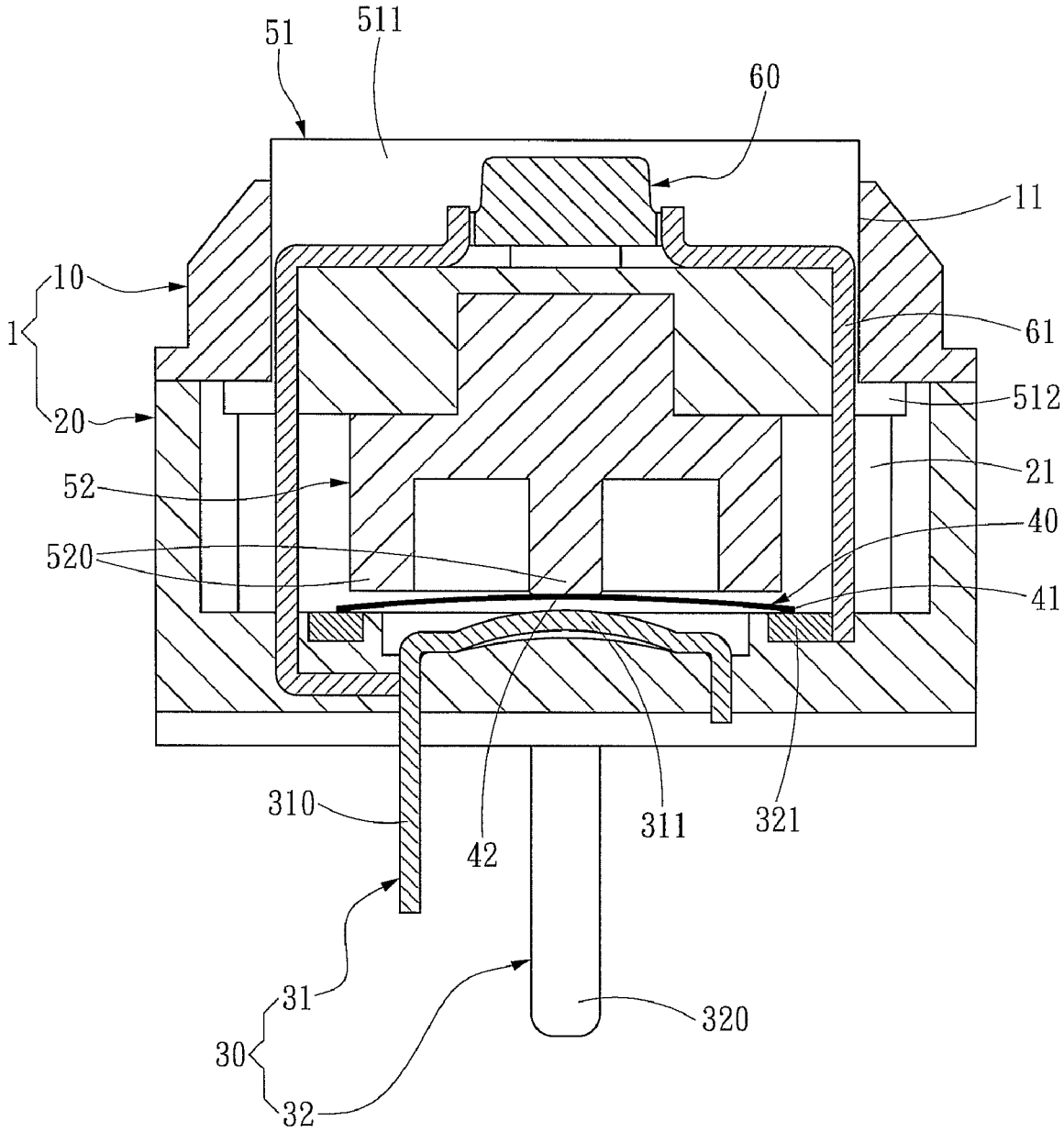
FIGS. 3A and 3B are schematic views of a second embodiment of the invention in operating conditions.
Figure 3B:
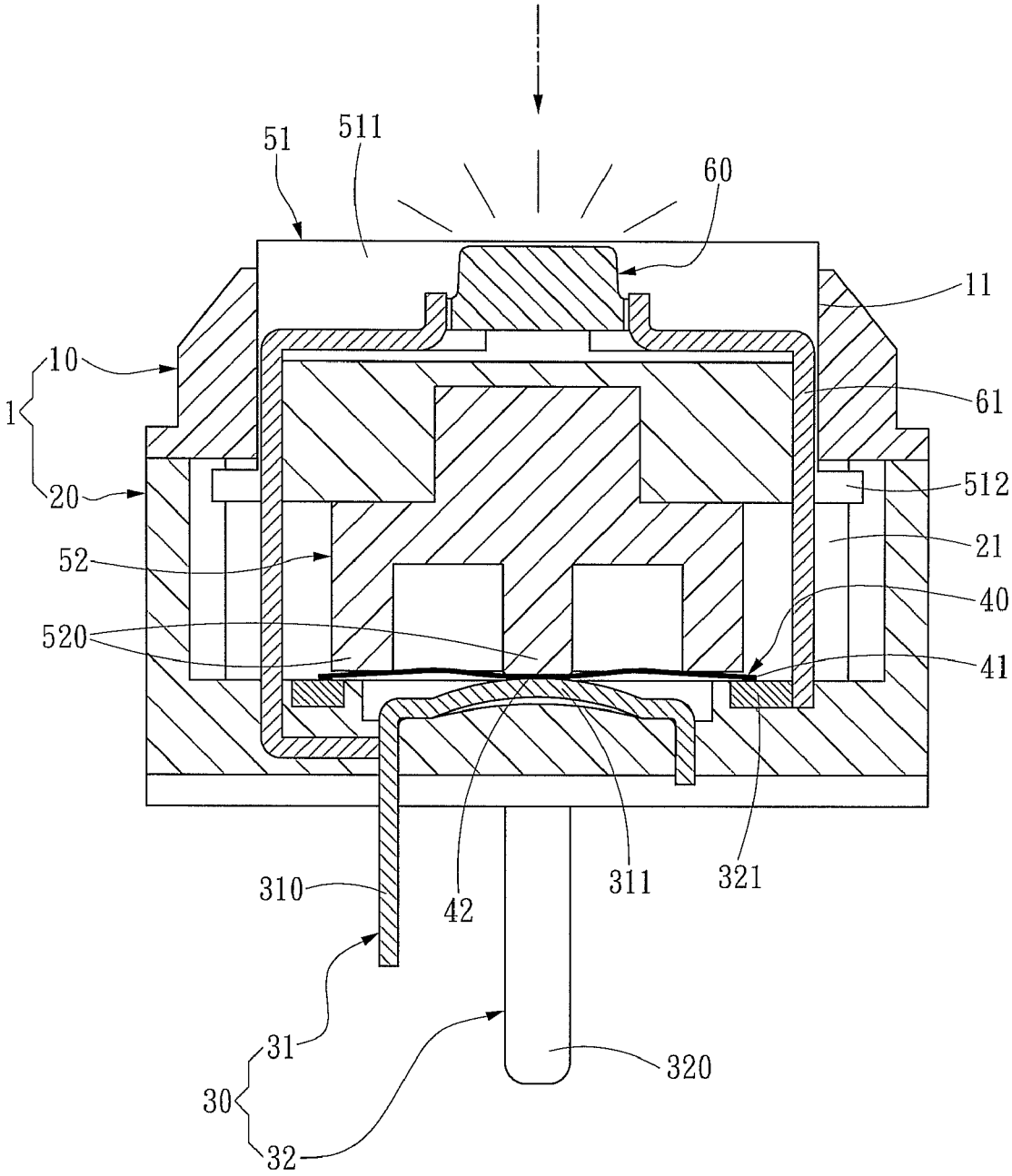

Referring to FIGS. 3A and 3B, the two conductive terminals 61 of the lighting element 60 may also be electrically connected to the first and second pins 31 and 32 to become conductive therewith at the same time. When the pushbutton 51 is not being depressed the first and second pins 31 and 32 are not connected and the lighting element 60 is OFF (i.e. not generating light, referring to FIG. 3A). When depressing action takes place the pushbutton 51 is depressed to push the bucking button 52 downwards, and the bridging member 40 also is pressed through the pressing end 520 so that the depressing sections 311 and 321 of the first and second pins 31 and 32 are electrically connected through the dome top portion 42 and the contact rim 41 to output the signal. Meanwhile the lighting element 60 generates light due to conductive connection of the first and second pins 31 and 32 (referring to FIG. 3B). When the depressing action stops, the pushbutton 51 is released from the depressing force and pushed by the bridging member 40 to its original position, and the first and second pins 31 and 32 are separated again to stop signal output, and the lighting element 60 returns to the OFF condition again as shown in FIG. 3A. The micro-switch thus formed generates light only in the depressed condition.

Figure 4:
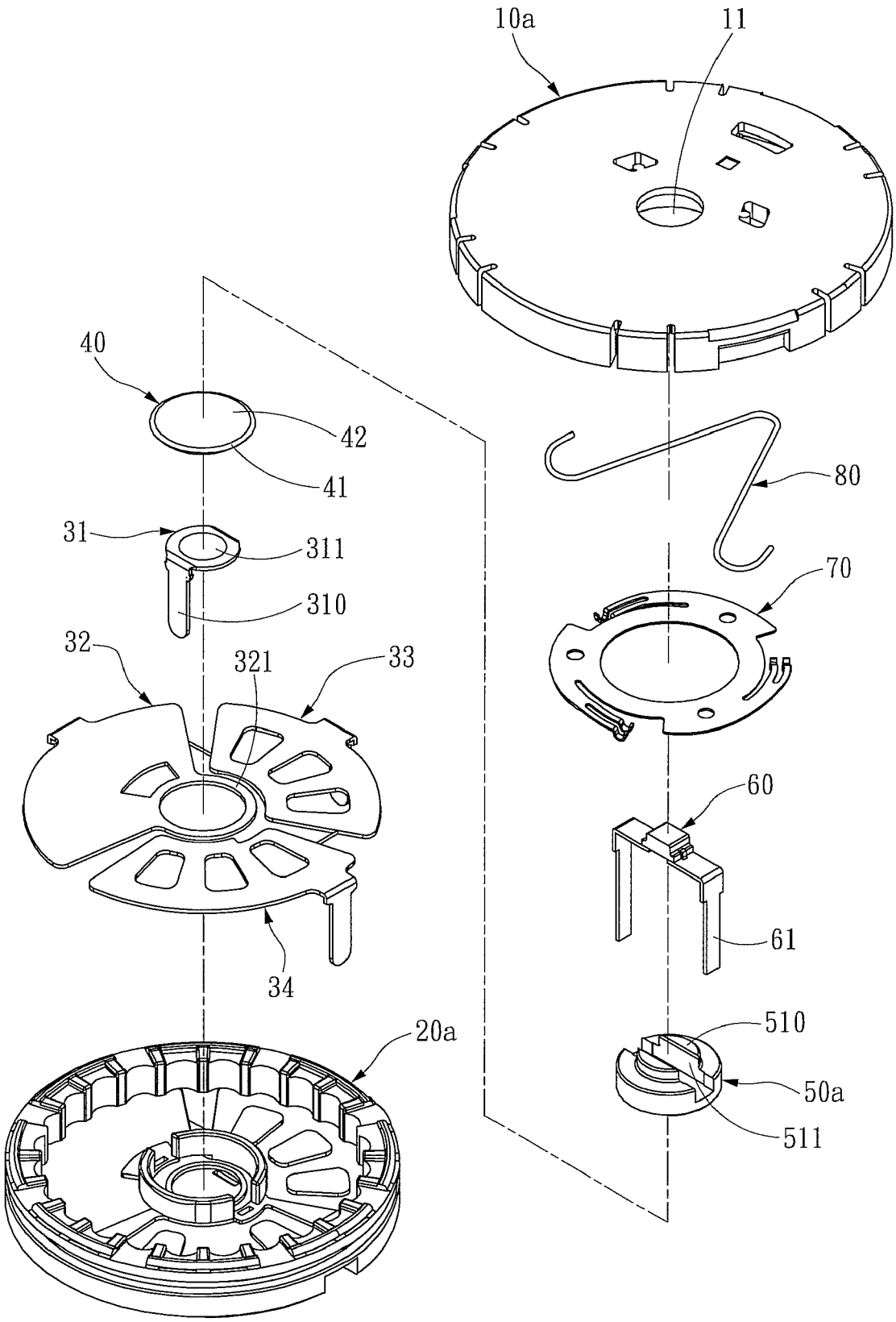
FIG. 4 is a schematic view of an embodiment of the invention in a use condition.
Figure 5:
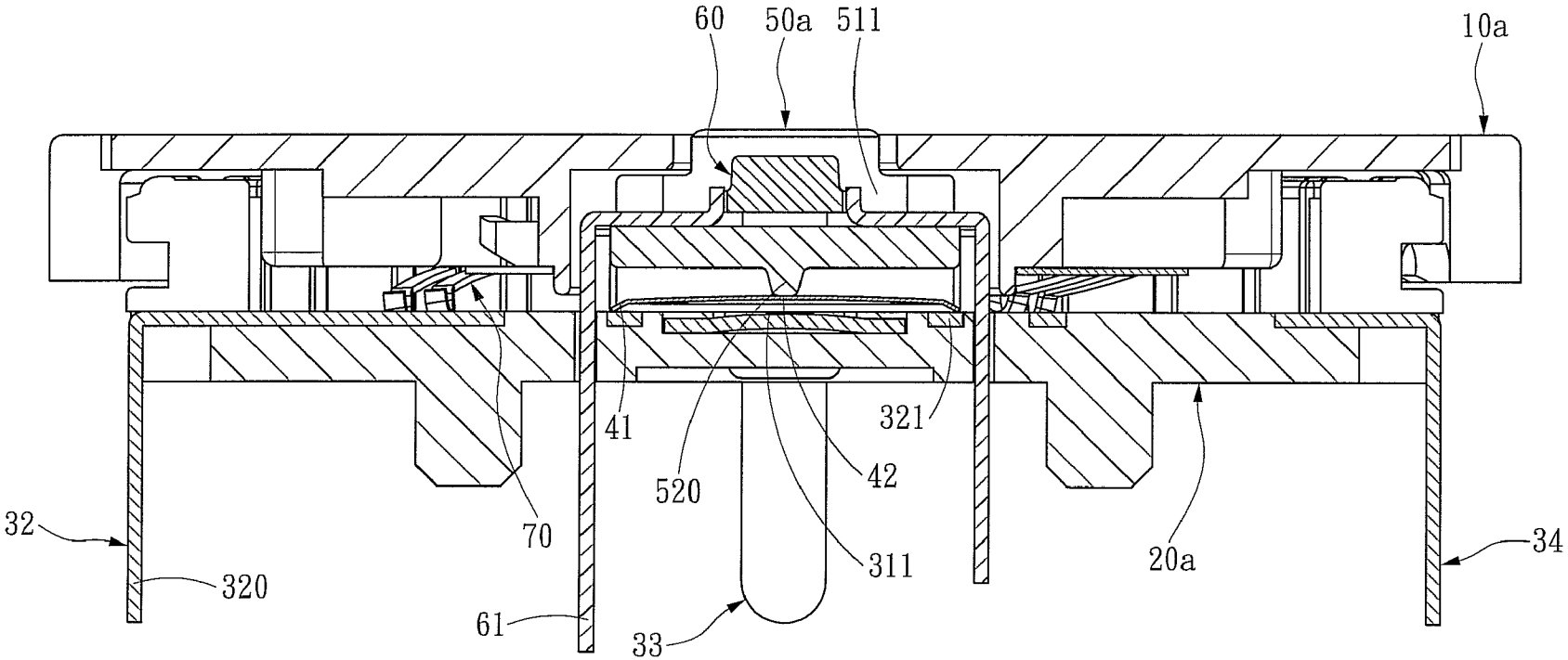
FIG. 5 is a cross section according to FIG. 4.
Figure 6:
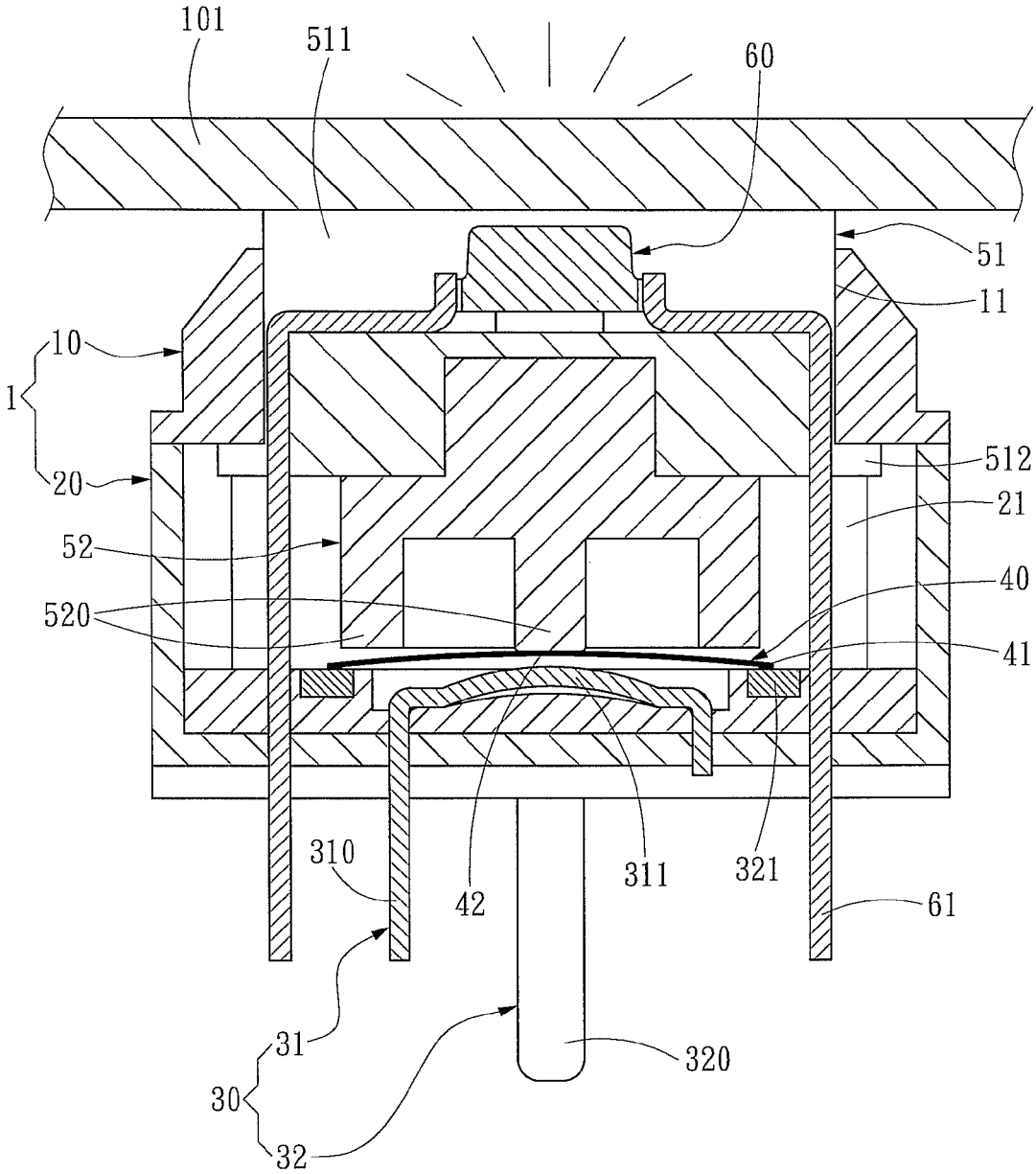
FIG. 6 is a schematic view of another embodiment of the invention in a use condition.

The luminous micro-switch of the invention may also be adopted to a multi-instruction switch which has disclosed in U.S. Pat. No. 7,145,087. The multi-instruction switch according to the U.S. Pat. No. 7,145,087 includes a control disk, an anchor member and a depressing element. The control disk can drive a first conductive element to rotate relative to the anchor member. When the first conductive element rotates, the first conductive element and a terminal connector of the anchor member generate output signal of circuit. The structure of the U.S. Pat. No. 7,145,087 could refer to the FIGS. 4 and 5 as one of embodiments of the present invention which disclose a multi-instruction switch that includes an upper cap 10*a* and a base 20*a* that are coupled together. The upper cap 10*a* has an anchor bar 80 and a circuit switch element 70, and the base 20*a* further has a third pin 33 and a fourth pin 34. The second, third and fourth pins 32, 33 and 34 and the circuit switch element 70 form a multi-set switch circuit. Details of description of the multi-instruction switch and the method for the circuit switch are disclosed in U.S. Pat. No. 7,145,087, thus are omitted herein. By rotating the upper cap 10*a* the switch circuit can output required instructions. By pushing the depressing member 50*a* signals can also be output. It is to be noted that the lighting element 60 is installed in the holding trough 511 of the depressing member 50*a*. Besides to generate light to facilitate user operation, the thickness of the multi-instruction switch can also be reduced so that the multi-instruction switch thus formed can be used on thinner products such as mobile phones, PDAs, MP3 and the like.

Figure 7:
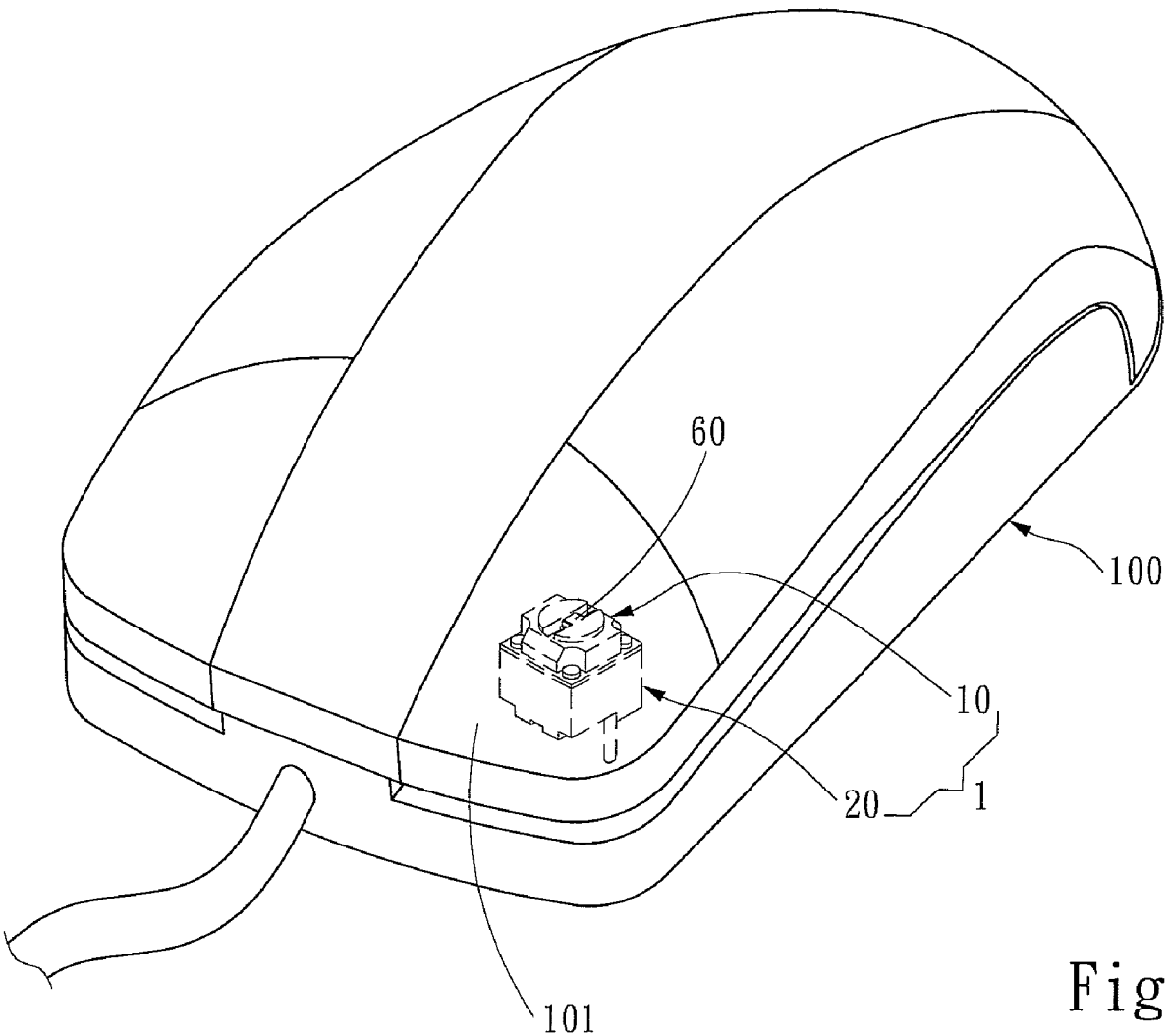
FIG. 7 is a schematic view of yet another embodiment of the invention in a use condition.

In addition, the light generated by the lighting element 60 may also be directed outwards through a transparent cover 101 disposed above the pushbutton 51. The transparent cover 101 may be a key casing commonly used on the conventional electronic devices. FIG. 7 illustrates an embodiment in which the luminous micro-switch is installed beneath the button of a mouse 100. Through the button made in the form of the transparent cover 101 the light generated by the lighting element 60 can be directed outwards. The lighting element 60 has two conductive terminals 61 which may be configured in varying fashions to emit light in regular conditions or under depressing.

As a conclusion, due to the invention has the lighting element 60 held in the holding trough 511 of the depressing end 510 the size of the entire switch can be made smaller. As a result the luminous micro-switch of the invention can be adopted to smaller electronic devices that increasingly become the main stream on the market.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A luminous micro-switch comprising:

a case;

an upper cap mounted on said case, said upper cap having a central opening;

a depressing member received in said case and protruding through said central opening;

at least a first pin and a second pin received in said case that are spaced from each other;

a bridging member interposed between the two pins and the depressing member to form an electric connection with the second pin in regular conditions, the bridging member being depressible through the depressing member to connect the first pin to output a signal; and the depressing member having a depressing end which has a holding trough to hold a lighting element which has two conductive terminals to receive electric power to generate light.

2. The luminous micro-switch of claim 1, wherein the two conductive terminals are extended outside the case to receive external electric power.

3. The luminous micro-switch of claim 1, wherein the two conductive terminals are electrically and respectively connected to the first pin and the second pin to become conductive therewith at the same time.

4. The luminous micro-switch of claim 1, wherein the depressing end has a transparent cover to direct the light outwards generated by the lighting element.

5. The luminous micro-switch of claim 1, wherein the depressing member includes a depressible pushbutton and a bucking button located beneath the pushbutton.

6. The luminous micro-switch of claim 1, wherein the case includes an upper cap and a base that are coupled together for positioning and form a housing chamber to hold the depressing member, the bridging member and the pins.

7. The luminous micro-switch of claim 6, wherein the depressing member includes a depressible pushbutton and a bucking button located beneath the pushbutton.

* * * * *